US008069828B2

(12) United States Patent
de Ojeda et al.

(10) Patent No.: US 8,069,828 B2
(45) Date of Patent: Dec. 6, 2011

(54) INTAKE VALVE CLOSING HYDRAULIC ADJUSTER

(75) Inventors: William de Ojeda, Chicago, IL (US); Daniel Cornelius, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 181 days.

(21) Appl. No.: 12/540,828

(22) Filed: Aug. 13, 2009

(65) Prior Publication Data

US 2011/0036316 A1 Feb. 17, 2011

(51) Int. Cl.
*F01L 9/02* (2006.01)

(52) U.S. Cl. ..... 123/90.12; 123/90.13; 123/90.15; 123/90.39; 123/90.61; 123/90.65

(58) Field of Classification Search ..... 123/90.12, 123/90.13, 90.15, 90.39, 90.61, 90.65; 92/112; 251/12, 14

See application file for complete search history.

(56) References Cited

U.S. PATENT DOCUMENTS

| | | | | |
|---|---|---|---|---|
| 3,678,906 | A | 7/1972 | Repko | |
| 4,483,283 | A | 11/1984 | Hausknecht | |
| 5,158,048 | A | 10/1992 | Robnett | |
| 5,829,397 | A | 11/1998 | Vorih et al. | |
| 6,044,815 | A | 4/2000 | De Ojeda | |
| 6,192,841 | B1 | 2/2001 | Vorih et al. | |
| 6,263,842 | B1 | 7/2001 | De Ojeda | |
| 6,338,320 | B1 | 1/2002 | De Ojeda | |
| 6,408,829 | B1 | 6/2002 | Lei | |
| 6,412,457 | B1 | 7/2002 | Vorih et al. | |
| 6,467,457 | B1 | 10/2002 | Lei | |
| 6,474,304 | B1 | 11/2002 | Lei | |
| 6,539,909 | B2 | 4/2003 | Yager | |
| 6,883,492 | B2 | 4/2004 | Vanderpoel et al. | |
| 6,978,747 | B2 | 12/2005 | Yager | |
| 7,059,282 | B2 | 6/2006 | Vorih et al. | |
| 7,168,250 | B2 | 1/2007 | Wei | |
| 7,168,396 | B1 | 1/2007 | Bulicz | |
| 7,228,826 | B2 * | 6/2007 | Chang | 123/90.12 |
| 7,347,172 | B2 | 3/2008 | Strickler | |
| 6,415,752 | B1 | 7/2009 | Janak | |
| 2003/0056745 | A1 | 3/2003 | Kammerdiener | |
| 2003/0217713 | A1 | 11/2003 | Richardson | |
| 2004/0194744 | A1 | 10/2004 | Yager | |
| 2004/0237921 | A1 | 12/2004 | de Ojeda | |
| 2006/0254542 | A1 | 11/2006 | Strickler | |

FOREIGN PATENT DOCUMENTS

| | | | |
|---|---|---|---|
| DE | 2005000621 | A1 | 7/2011 |
| JP | 7083013 | A | 3/1995 |

* cited by examiner

*Primary Examiner* — Ching Chang
(74) *Attorney, Agent, or Firm* — Jack D. Nimz; Jeffrey P. Calfa

(57) ABSTRACT

A mechanism (40) for enabling an engine cylinder valve (18) to close at various times during engine cycles has a hydraulic actuator (58) and a control valve (60) controlling the hydraulic actuator a) to constrain a pivot axis of a valve rocker (52) against relocation while the cylinder valve is being forced increasingly open, and b) to release the constraint after the cylinder valve has been forced open for enabling the pivot axis to relocate so that the intake valve can close early thereby providing early IVC. A hydraulic snubber (64) snubs closing motion of the cylinder valve through a scheduling geometry to a hydraulic accumulator (62). The control valve opens to the accumulator to allow the rocker pivot axis to relocate and provide early IVC and closes to return the pivot axis to a location that doesn't provide early IVC.

29 Claims, 6 Drawing Sheets

INTAKE VALVE CLOSING HYDRAULIC ADJUSTER

TECHNICAL FIELD

This disclosure relates to internal combustion engines, and in particular it relates to a mechanism for controlling timing of engine cylinder valve operation, especially timing of cylinder intake valve closing.

BACKGROUND OF THE DISCLOSURE

Control of combustion phasing in an internal combustion engine is useful when applied to EGR (exhaust gas recirculation), fuel injection timing, and cylinder cooling strategies. Poor calibration however may at times cause undesired engine operation, such as misfire in ranges where EGR rates are high. Non-uniform EGR distribution or in-cylinder cooling can also lead to cylinder-to-cylinder variability of combustion phasing.

The applicants believe that control of intake valve closing (IVC) on an individual engine cylinder basis can provide better overall control of a multi-cylinder diesel engine. Control can be further improved in the presence of a combustion phasing feedback, such as cylinder pressure or ion sensing technology.

SUMMARY OF THE DISCLOSURE

This disclosure relates to a mechanism that can be applied to an individual engine cylinder to provide variable valve actuation (VVA), especially variable closing of an intake valve for an individual engine cylinder to effectively control the cylinder compression ratio.

The applicants believe that in combination with a turbocharger system and EGR control, the disclosed mechanism can limit NOx in engine exhaust without having to de-rate an engine to a level would that would limit NOx without having to use an expensive exhaust after-treatment system containing a lean NOx trap (LNT) or an SCR (selective catalytic reduction) catalyst.

A general aspect of the disclosure relates to an internal combustion engine comprising an intake system through which air enters at least one engine cylinder within which the air supports combustion of fuel to operate the engine and an exhaust system through which products of in-cylinder combustion are exhausted. Cylinder valves control communication of the respective systems with the at least one cylinder.

One of the cylinder valves is biased closed by a valve spring to seat on a valve seat but is increasingly opened by a rocker of a valve opening mechanism pivoting about a relocatable axis and increasingly compressing the valve spring as the one valve increasingly opens.

A hydraulic actuator hydraulically locks the relocatable axis against relocation as the one valve is being increasingly opened by the rocker, and with the one valve open, unlocks the relocatable axis to allow the valve spring to increasingly expand and simultaneously force the one valve toward the valve seat and the relocatable axis to relocate.

A hydraulic fluid pressure source delivers hydraulic fluid through a first check valve to a variable volume chamber of a hydraulic snubber that is disposed to snub motion of the one valve toward the valve seat, through a second check valve to a variable volume chamber of the actuator, and to a hydraulic accumulator that is in fluid communication with the snubber chamber and a first port of a control valve that has a second port in fluid communication with the actuator chamber.

The variable volume chamber of the snubber is cooperatively defined by a snubbing element and by a body with respect to which the snubbing element is extendable and retractable.

The snubbing element and the snubber body collectively comprise a variable restriction through which the variable volume chamber of the snubber is in fluid communication with the accumulator, the hydraulic fluid pressure source, and the first port of the control valve, and which decreases and increases respectively as the snubbing element extends and retracts respectively relative to the snubber body.

The hydraulic fluid pressure source and accumulator collectively are effective, as the valve opening mechanism is increasingly opening the one valve, to force hydraulic fluid through the first check valve into the snubber chamber and thereby extend the snubbing element relative to the snubber body.

During increasing opening of the one valve by the valve opening mechanism, the control valve closes the first port to the second port to hydraulically lock the actuator by preventing hydraulic fluid that had been forced into the actuator chamber before the one valve was unseated from the valve seat from escaping from the actuator chamber.

With the one valve open, the control valve opens the first port to the second port to unlock the actuator by communicating the actuator chamber to the accumulator and consequently allow the valve spring to force hydraulic fluid out of the actuator chamber into the accumulator as the one valve is being forced toward the seat by the valve spring and snubbed by interaction with the snubber that forces the snubbing element to retract and force fluid out of the snubber chamber into the accumulator with increasing restriction as the one valve moves toward the seat.

Another general aspect of this disclosure relates to a mechanism for association with an engine cylinder valve that is biased closed on a valve seat by a valve spring and opened by a valve rocker of a valve opening mechanism for endowing the cylinder valve with the capability of being operated from open to closed at various times during engine cycles.

The mechanism comprises a hydraulic actuator comprising a variable volume chamber and a control valve controlling the hydraulic actuator a) to constrain a pivot axis of the valve rocker against relocation while the valve opening mechanism is operating the valve rocker to force the cylinder valve increasingly open and increasingly compressing the valve spring, and b) to release the constraint after the cylinder valve has been forced open for enabling the pivot axis to relocate as the valve spring increasingly extends to move the cylinder valve toward closing on the valve seat.

A first check valve allows hydraulic fluid from a hydraulic fluid pressure source and a hydraulic accumulator that is in fluid communication with the source to be introduced to expand the volume of the chamber and disallow back-flow of fluid from the chamber.

A hydraulic snubber comprising a variable volume chamber snubs motion of the cylinder valve toward closing on the valve seat.

A second check valve allows hydraulic fluid from the hydraulic fluid pressure source to expand the volume of the snubber chamber and disallow back-flow of fluid from the snubber chamber.

The variable volume chamber of the snubber is cooperatively defined by a snubbing element and by a body with respect to which the snubbing element is extended by hydraulic fluid introduced into the snubber chamber through the second check valve.

The snubbing element and the snubber body cooperatively comprise a variable restriction through which the snubber chamber communicates with the accumulator and which varies as the snubbing element retracts relative to the snubber body.

The control valve provides the functions of causing the actuator to constrain the axis against relocation by closing the actuator chamber to the accumulator and of causing the actuator to release the constraint by opening the actuator chamber to the accumulator and consequently enable the valve spring to act via the rocker to force fluid out of the actuator chamber into the accumulator, and via cylinder valve interaction with the snubbing element, to force fluid out of the snubber chamber and into the accumulator with increasing restriction of fluid flow by the variable restriction as the snubbing element is increasingly retracted.

The disclosure also relates to a method of operating an engine cylinder valve that is biased closed on a valve seat by a valve spring, that is opened by pivoting of a valve rocker of a valve opening mechanism about a relocatable axis during an engine cycle, and whose closing motion toward the valve seat is snubbed by a hydraulic snubber.

The method comprises communicating a variable volume chamber of the snubber through a first check valve to a hydraulic fluid pressure source to allow fluid to flow into the snubber chamber and disallow backflow from the snubber chamber, communicating a variable volume chamber of a hydraulic actuator through a second check valve to a hydraulic accumulator that is in fluid communication with the hydraulic fluid pressure source to allow fluid to flow into the actuator chamber and disallow backflow from the actuator chamber, communicating the actuator chamber through a control valve to the source, the accumulator, and the snubber, selectively operating the control valve a) to constrain the relocatable axis of the valve rocker against relocation by closing the actuator chamber to the accumulator, the source, and the snubber chamber as the valve opening mechanism is operating the valve rocker to force the cylinder valve increasingly open and increasingly compress the valve spring, thereby hydraulically locking the actuator during cylinder valve opening, and b) after the cylinder valve has been forced open, to release the constraint by opening the actuator chamber to the accumulator, the source, and the snubber chamber, thereby unlocking the actuator so that the axis can relocate as the valve spring increasingly extends to force fluid out of the actuator chamber and move the cylinder valve toward closing on the valve seat.

As the cylinder valve interacts with the snubber during closing motion toward the valve seat, snubbing the closing motion by causing the snubber to increasingly restrict flow of hydraulic fluid being forced out of the snubber chamber by the valve spring forcing the cylinder valve toward the valve seat.

Another aspect of the disclosure relates to a hydraulic snubber for snubbing closing motion of an engine cylinder valve on a seat.

The snubber comprises a variable volume chamber cooperatively defined by a snubbing element and by a body with respect to which the snubbing element is linearly displaceable, a source port through which hydraulic fluid from a hydraulic fluid pressure source can be delivered to the variable volume chamber for hydraulically biasing the snubbing element in a direction of linear extension with respect to the body, a drain port through which hydraulic fluid from the variable volume chamber can drain when closing motion of the cylinder valve forces the snubbing element in a direction of linear retraction with respect to the body, and a variable restriction through which hydraulic fluid in the variable volume chamber is forced to the drain port when the snubbing element is displaced in the direction of linear retraction.

The variable restriction comprises a scheduling aperture geometry that extends through a hollow cylindrical wall portion of a tail end of the snubbing element and that moves across an undercut in an inner surface of a cylindrical wall portion of the snubber body surrounding the hollow cylindrical wall portion of the tail end of the snubbing element as the snubbing element is displaced in the direction of linear retraction.

Another aspect of the disclosure relates to a method for using early IVC in an internal combustion engine that has a VVA mechanism having a hydraulic actuator for controlling the location of the pivot axis of a rocker through which motion of a push rod is transmitted to open a cylinder intake valve that is biased closed by a valve spring and a selectively operable control valve that is selectively opened and closed to hydraulically unlock and lock the actuator for allowing and disallowing the location of the pivot axis to move away from a defined location that provides no early IVC to a location that provides early IVC.

The method comprises opening the control valve during engine cranking to provide some degree of early IVC that causes some oil and any entrained air to be forced out of the actuator to an accumulator that has fluid communication with a source of pressurized oil by action of the valve spring causing the pivot axis to move from the defined location to a location that provides early IVC, and after the intake valve closes, keeping the control valve open long enough to allow oil to return from the accumulator to the actuator and move the pivot axis to the defined location.

The foregoing summary, accompanied by further detail of the disclosure, will be presented in the Detailed Description below with reference to the following drawings that are part of this disclosure.

DETAILED DESCRIPTION

Figure 1:
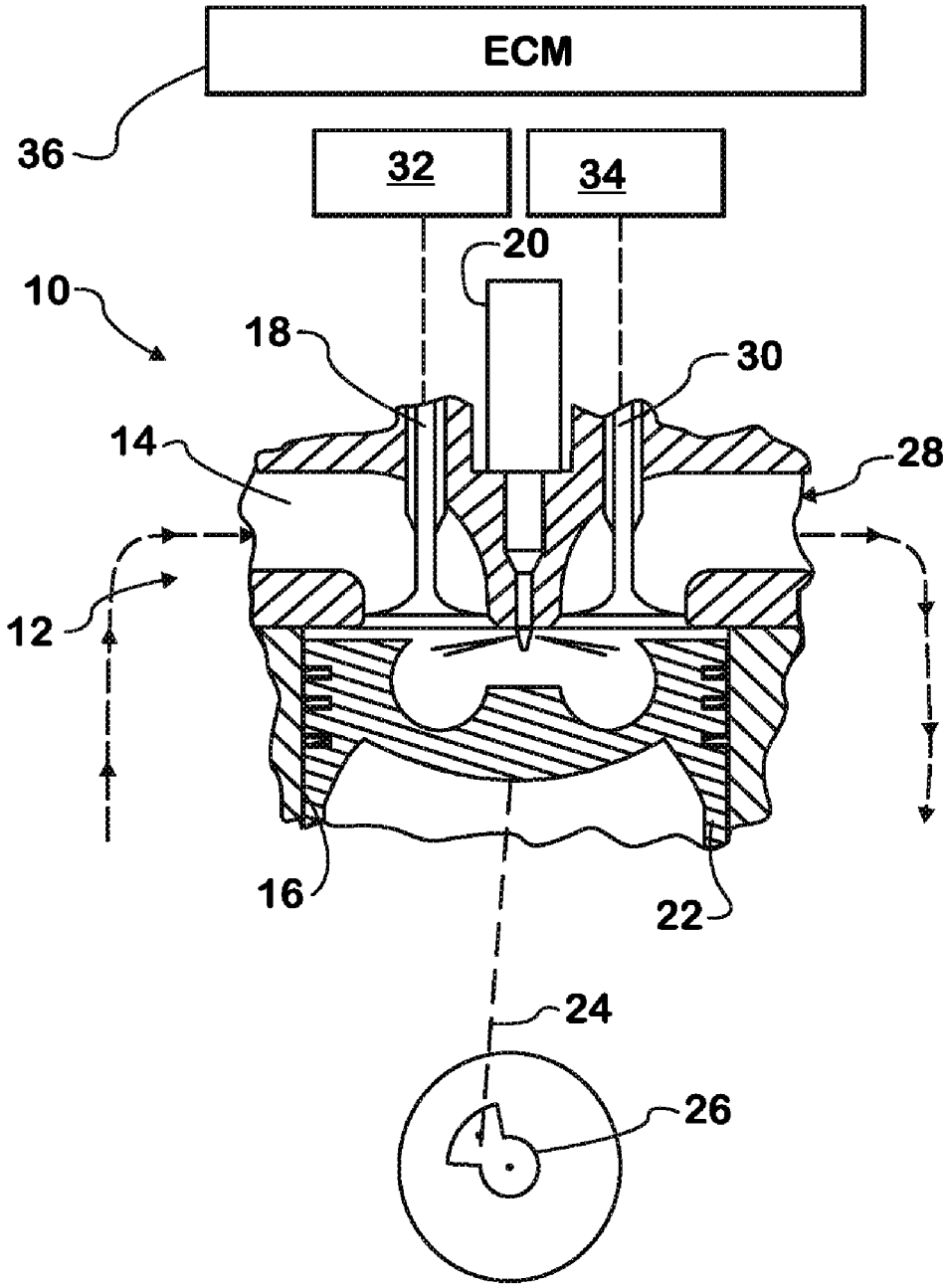
FIG. 1 is a generally schematic diagram of one cylinder of a diesel engine.

FIG. 1 illustrates a portion of an internal combustion engine 10, such as a diesel engine that powers a motor vehicle.

Engine 10 comprises an intake system 12 through which charge air is delivered to an intake manifold 14 of engine 10. Charge air enters each engine cylinder 16 from manifold 14 via a corresponding intake valve 18. Individual fuel injectors 20 inject diesel fuel into individual engine cylinders in properly timed relation to engine operation. The injected fuel combusts in the presence of the hot compressed air in the cylinder to force a power stroke of a piston 22 connected by a rod 24 with a crankshaft 26.

Engine 10 further comprises an exhaust system 28 for conveyance of exhaust gases created by combustion within the engine cylinders from the engine. Exhaust gases pass out of each cylinder via a respective exhaust valve 30.

The normally closed intake and exhaust valves at each cylinder are opened and closed at appropriate times during the engine cycle by a mechanism, designated in the drawing by the reference numeral 32 for intake valve 18 and by the reference numeral 34 for exhaust valve 30.

An electronic engine control module (ECM) 36 that possesses digital processing capability is associated with engine 10. ECM 36 comprises one or more processors that process data from various input data signal sources in accordance with programmed algorithms to develop certain data for signals used in the performance of various functions associated with operation of engine 10.

Turbocharging of engine 10 is accomplished by a turbocharger that is not specifically shown. Engine 10 also contains an EGR system, which too is not specifically shown.

Figure 2:
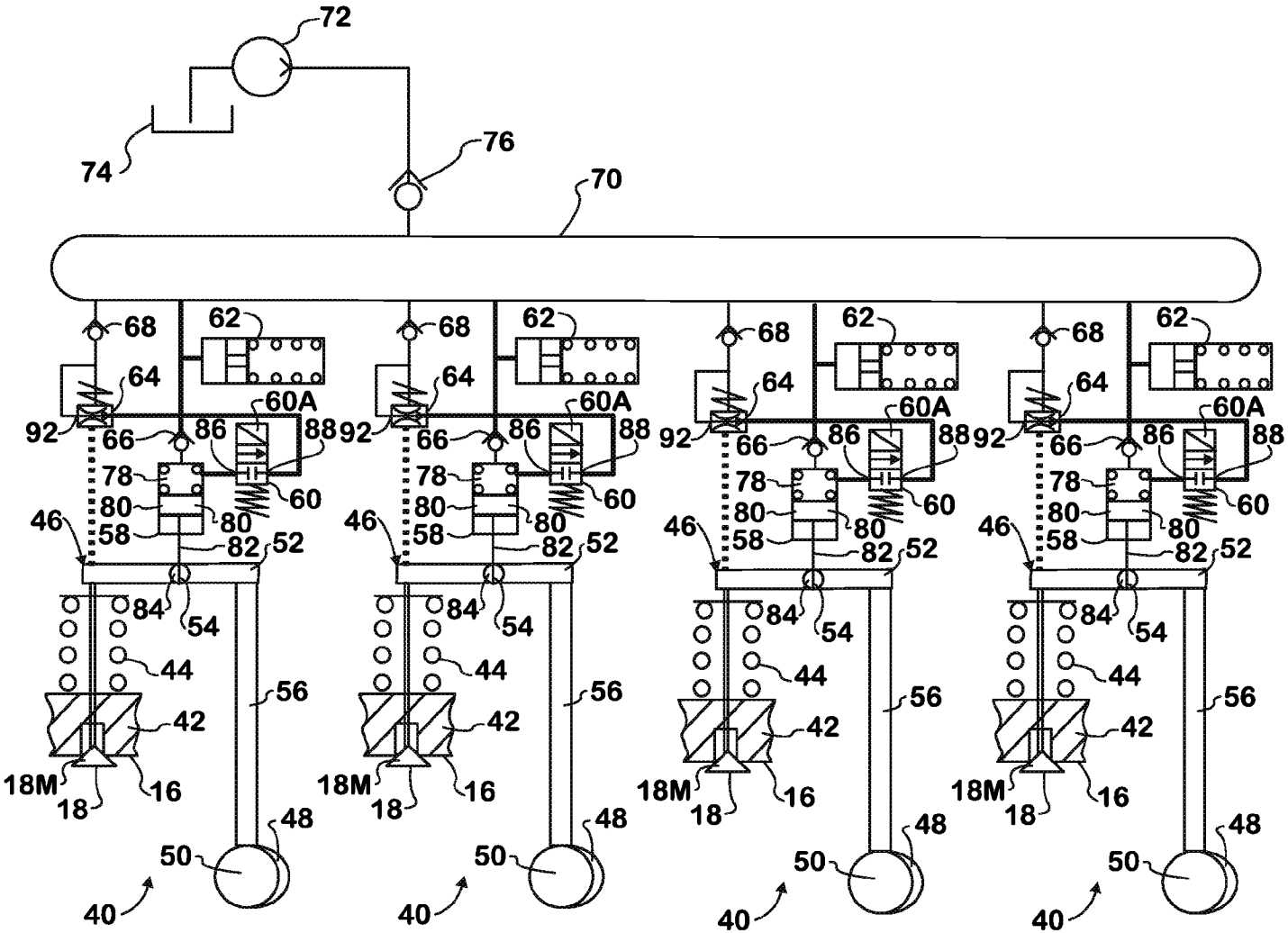
FIG. 2 is a schematic diagram of a bank of four engine cylinders with each of which a mechanism of the present disclosure is associated.

FIG. 2 shows four mechanisms 40, each for a respective engine cylinder. The illustrated positions of movable elements of various devices in each mechanism may not necessarily be the exact ones that they would have during engine operation because FIG. 2 is intended simply to introduce the various devices and how they are arranged in each mechanism. Actual operation of moving elements in a mechanism will be described later in connection with other Figures. It is to be understood that because the cylinders have a particular firing order, the engine cycles of the cylinders are also out of phase causing the positions of moving elements in each mechanism 40 to also be out of phase with those of moving elements of the other mechanisms.

Each intake valve 18 has a head 18H that seats on and unseats from a valve seat in a cylinder head 42. A spring 44 biases each head 18H to seat on the respective seat closing the respective cylinder to intake manifold 14.

A valve opening mechanism 46 for each intake valve comprises a respective cam 48 on a camshaft 50 and a respective rocker 52. Each rocker 52 can pivot about a relocatable axis 54 and comprises opposite ends, one of which provides a point of interaction between the rocker and the respective intake valve and the other of which provides a point of interaction with an end of a push rod 56 that is operated by the respective cam 48.

Each mechanism 40 comprises a hydraulic actuator 58, a fast-acting control valve 60, an accumulator 62, a hydraulic snubber 64, and two check valves 66, 68. Hydraulic fluid used by mechanism 40 is provided by oil from an oil rail 70 that, depending on the type of fuel injectors, may also supply oil to fuel injectors 20 for injecting fuel into cylinders 16 and that is kept filled with pressurized oil by a pump 72 that pumps oil from a sump 74 into the oil rail through a check valve 76.

Actuator 58 comprises a variable volume chamber 78 that expands by pushing an internal piston 80 toward one end of the actuator when oil is introduced into the chamber. A piston rod 82 protrudes from that one end and moves with piston 80, increasingly extending as the chamber expands. A distal end of piston rod 82 is pinned to rocker 52 by a cylindrical pin 84 whose longitudinal axis is coincident with axis 54.

Actuator chamber 78 communicates with one port 86 of valve 60. Another port 88 of valve 60 communicates with accumulator 62, oil rail 70, and one port 90 of snubber 64. Oil from oil rail 70 is supplied to another port 92 of snubber 64 through check valve 68. Oil from oil rail 70 is also supplied to actuator chamber 78 through check valve 66.

Valve 60 is spring-biased closed to block flow between port 90 and port 92, but comprises an electric operator 60A that when operated by an electric signal opens the valve so that fluid can flow between its two ports.

FIG. 2 shows each cylinder intake valve 18 closed, each push rod 56 off the lobe of the respective cam 48, and moving parts of each mechanism in identical positions, a showing that doesn't reflect the different firing order discussed earlier. Operation of mechanism 40 for one cylinder starting from the position shown in FIG. 2 will now be discussed with reference to FIGS. 3 and 4.

As camshaft 50 turns counterclockwise from the FIG. 2 position, the lobe of cam 48 pushes push rod 56 upward causing rocker 52 to pivot counterclockwise about axis 54 and force valve 18 to unseat, further compressing spring 44 in the process. During this time, actuator 58 is kept hydraulically locked by valve 60 being closed, preventing oil that is present in chamber 78 from escaping, and constraining axis 54 from relocating (i.e. locking axis 54) so that rocker 52 acts as a first class lever. If actuator 58 were not hydraulically locked, the upward motion of pushrod 56 would cause rocker 52 to act as a second class lever because the lack of constraint of axis 54 would instead cause rocker 52 to pivot about its point of interaction with valve 18, thereby moving axis 54 until an upward travel limit for the axis is reached.

As long as actuator 58 is kept hydraulically locked so that pin 84 cannot relocate, the opening of valve 18 is controlled exclusively by cam 48 because the continuous action of spring 44 on the end of rocker 52 to one side of axis 54 keeps the opposite end of the rocker biased against one end of push rod 56 to keep the opposite end of the push rod on the cam. In this locked condition, valve 18 cannot open early.

Figure 3:
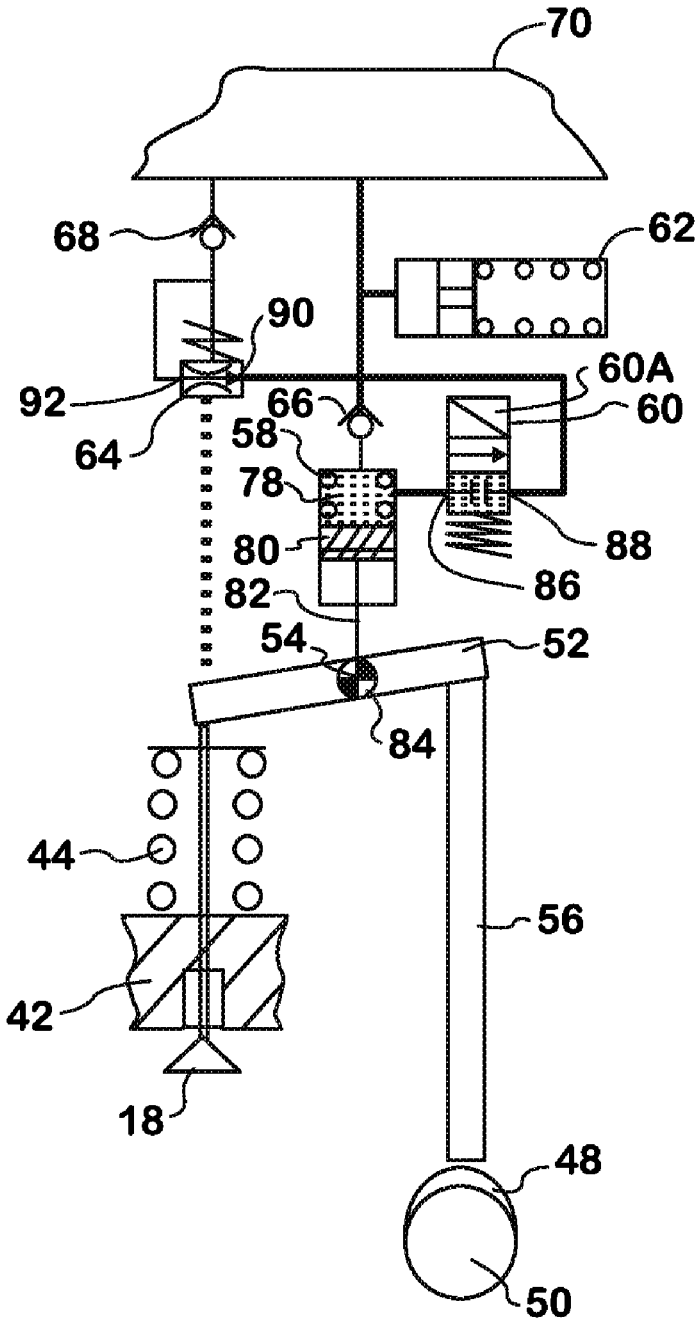
FIG. 3 is an enlarged diagram of one of the cylinders and its associated mechanism at a time in the engine cycle when the cylinder intake valve is open.

FIG. 3 shows valve 18 essentially fully open. When early closing is appropriate for the particular engine control strategy contained in ECM 36, each mechanism 40 provides early IVC for each engine cylinder by allowing pin 84 to relocate. With valve 18 open, early IVC is initiated by a signal from ECM 36 being effective on electric operator 60A to cause control valve 60 to open, thereby unlocking actuator 58 to allow pin 84 to relocate. With port 86 open to port 88, oil in actuator chamber 78 is forced out through valve 60 because axis 54, having become unlocked with the unlocking of actuator 58, now enables rocker 52 to act as a second class lever with spring 44 pivoting the rocker clockwise about the rocker's point of interaction with push rod 56. With rocker 52 being pivoted in this way, piston rod 82 is forced to retract into actuator 58, pushing piston 80 to force oil out of chamber 58 as the chamber volume contracts.

Because of its direct exposure to chamber 78 through open valve 60, accumulator 62 can immediately accept the oil being forced out of actuator 58 regardless of whatever ability oil rail 70 may have at the time to accept oil because it too is open to chamber 78 through open valve 60. The fluid that is accepted by accumulator 62 becomes available for re-use, as will be more fully explained shortly.

Figure 4:
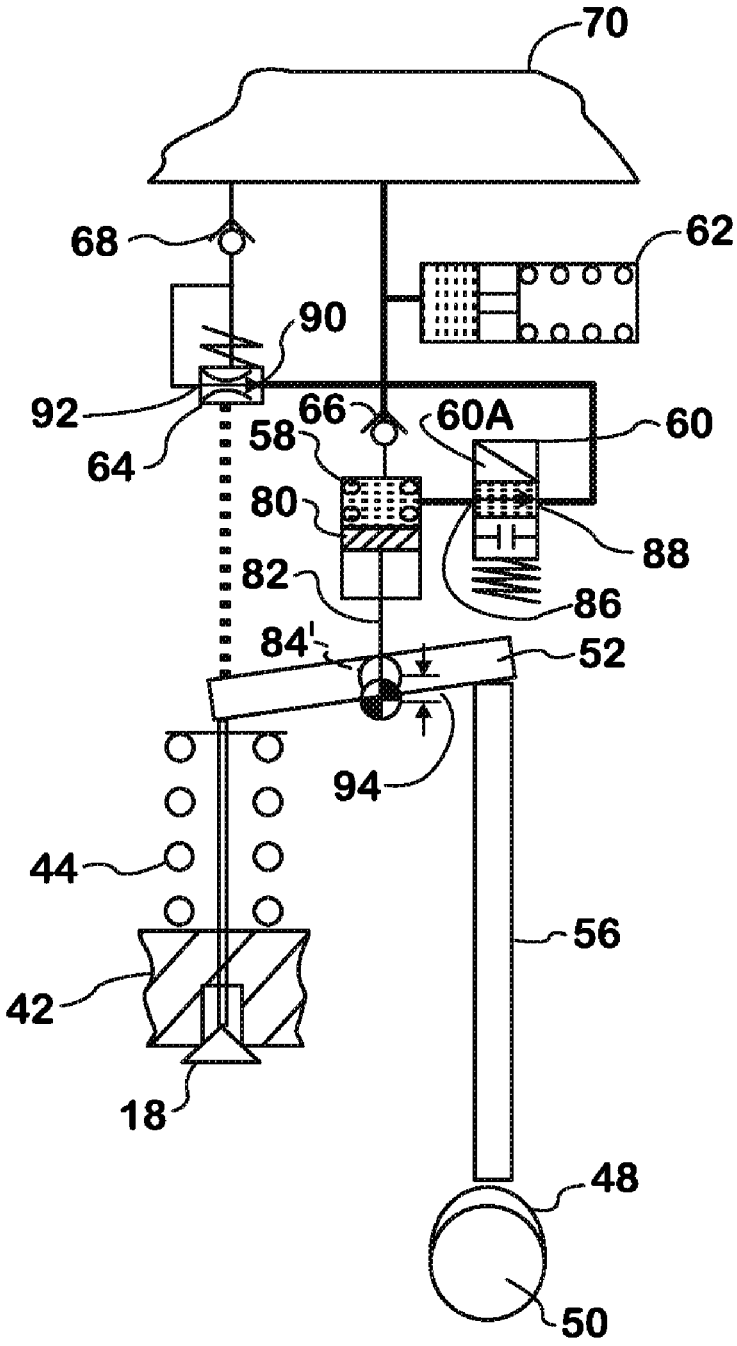
FIG. 4 is a diagram similar to FIG. 3 but at a different time in the engine cycle.

FIG. 4 shows valve 18 seated closed after early IVC resulting from the unlocking of actuator 58 as explained above, with pin 84 having moved upward a distance 94 from the position shown in FIG. 3 to the position marked 84' in FIG. 4.

Before valve 18 is once again opened by cam 48 during the next engine cycle, pin 84 returns from the position 84' in FIG. 4 to the position in FIG. 3 in the following way.

Valve 60 remains open as cam 48 continues turning Having stored the oil that was forced out of actuator 58, accumulator 62, now functions to restore that oil by forcing it through valve 60 into actuator 58 to move pin 84, and hence rocker axis 54, to the FIG. 3 position as push rod 56 comes off the cam lobe to allow the push rod to move downwardly and thereby enable the accumulator to force oil into the actuator to extend piston rod 82. Once the push rod has come entirely off the cam lobe, valve 60 is closed to hydraulically lock actuator 58 with axis 54 in the FIG. 3 position.

Accumulator 62 thereby not only minimizes the mechanism's consumption of oil from oil rail 70, but by providing the ability to quickly take in oil, it also enables prompt early IVC when valve 60 opens.

While snubber port 90 is also exposed directly to actuator chamber 78 through open valve 60, snubber 64 typically doesn't affect the initial early closing of valve 18. Snubber 64 functions to snub the final motion of valve 18 toward closing on the valve seat in cylinder head 42, as will be explained in more detail with reference to FIGS. 5 and 6.

Snubber 64 comprises a variable volume chamber 96 cooperatively defined by a snubbing element 98 and by a body 100 with respect to which the snubbing element is extendable and retractable. Snubbing element 98 comprises a head end 102 that protrudes from body 100 for interaction with intake valve 18 and a tail end 104 that remains inside body 100 as snubbing element 98 extends and retracts.

Snubber 64 provides a restriction to flow of oil between port 90 and port 92 for snubbing closing motion of valve 18 as the valve is approaching the valve seat. While the restriction generally increases as the valve increasingly nears the seat, it may not increase uniformly. The manner in which the restriction changes is set by a scheduling aperture geometry that extends through a hollow cylindrical wall portion 106 of tail end 104 that moves across an undercut 108 in an inner surface of a cylindrical wall portion 110 of snubber body 100 surrounding wall portion 106 as snubbing element 98 is increasingly retracted. In the illustrated embodiment, the scheduling aperture geometry comprises four discrete through-apertures 112, 114A, 114B, 116.

Wall portion 106 is closed to head end 102, and consequently surrounds a volume that forms a lower portion of snubber chamber 96 whose upper portion is surrounded by wall portion 110 of body 100 and closed by a top end wall 118. Port 92 is at the top of end wall 118 and communicated to chamber 96 through a passage 120 in end wall 118.

Undercut 108 extends 360° around wall portion 110 and has a constant axial dimension throughout. A passage 122 in wall portion 110 communicates undercut 108 to port 90.

Figure 5:
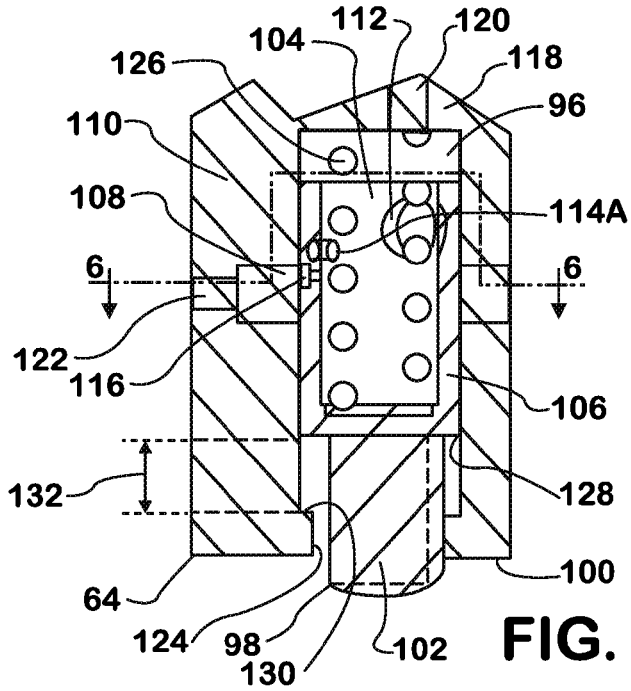
FIG. 5 is a partial longitudinal cross section view showing one of the devices of the mechanism by itself.
Figure 6:
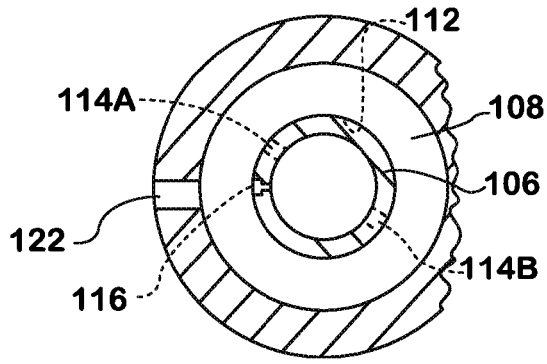
FIG. 6 is a transverse cross section view taken along line 6-6 in FIG. 5.

The four through-apertures are arranged in a pattern where each is offset circumferentially from the others, with through-apertures 114A, 114B being diametrically opposite each other and having identical open areas. Through-aperture 112 is more distant from head end 102 than are through-apertures 114A, 114B and also has an open area that is greater than the sum of the open areas of through-apertures 114A, 114B. FIG. 6 shows through-aperture 114A offset counterclockwise and through-aperture 114B offset clockwise from through-aperture 112. FIG. 5 shows through-apertures 114A, 114B more distant from head end 102 than through-aperture 116, and each also having an open area that is greater than that of through-aperture 116. FIG. 6 shows through-aperture 116 offset counterclockwise from through-aperture 114A.

The bottom end of snubber body 100 has an opening 124 through which head end 102 protrudes. In the absence of hydraulic pressure, a spring 126 biases snubbing element 98 so that a shoulder 128 of the element is forced against a lip 130 of the body surrounding opening 124 to set the maximum distance that head end 102 can protrude. In that condition, chamber 96 is open to undercut 108 only via through-aperture 112.

In the absence of valve 18 exerting an upward force on snubbing element 98, the pressure of oil in rail 70 forces oil to flow through check valve 68 and into snubber chamber 96 to extend snubbing element 98 until shoulder 128 abuts lip 130. In this state, snubber 64 is ready to snub closing motion of valve 18 once the valve has moved sufficiently to interact with element 98. Snubbing will occur regardless of whether early IVC is being used.

With snubbing element 98 fully extended, the upward motion of valve 18 that is being forced by valve spring 44 on the snubbing element forces it to retract, contracting the volume of chamber 96 in the process. The contracting volume forces oil first through through-aperture 112 and successively through-apertures 114A, 114B, 116 with increasing restriction to flow due to the through-aperture scheduling geometry as the snubbing element increasingly retracts. Because accumulator 62 is directly communicated to port 90, it can immediately accept the oil being forcefully drained out of the snubber.

Consequently, valve closing motion is snubbed in a manner that assures substantially constant landing speed on the valve seat because through-aperture 116 is the only one through which oil can pass during a final increment of valve travel approaching re-seating and when the valve finally re-seats after having traveled the distance indicted by the numeral 132.

Figure 7:
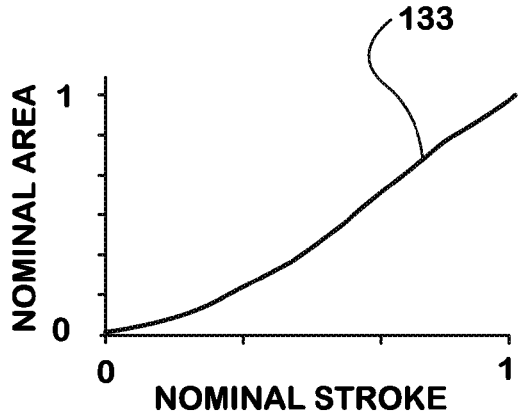
FIGS. 7, 8, and 9 are respective graph plots useful in explaining certain aspects of the operation of the mechanism during an engine cycle.

FIG. 7 shows a graph plot containing a trace 133 representative of the relationship of the open area of the snubber scheduling geometry presented to undercut 108, i.e. the restriction between ports 90 and 92, as a function of linear displacement of snubbing element 98. The horizontal axis represents snubbing element displacement, or stroke, and the vertical axis, the corresponding open area of the scheduling geometry presented to undercut 108. The graph plot is normalized rather than dimensioned. Trace 133 begins at "zero" and ends at "one" along the horizontal axis At its beginning, trace 133 has a "non-zero" value corresponding to the open area of through-aperture 116. At its end, trace 133 has a value "one" corresponding to shoulder 128 abutting lip 130. Constant intake valve landing speed that is essentially independent of engine speed is achieved by locating through-aperture 116 such that it is the only through-aperture in the scheduling geometry that is in registration with undercut 108 during a final increment of valve travel before landing. In this way the valve can properly retract under a variable range of tolerance stack-ups and valve growth while landing speed is substantially constant throughout the engine speed range and valve duration command. Because snubbing element 98 can have a relatively long stroke beyond the valve landing ramp, and hence a longer time during which it can interact with the valve closing motion, effects such as contact stresses, pressure fluctuations, and/or noise that might occur during a shorter interaction time resulting may be mitigated or avoided.

Figure 8:
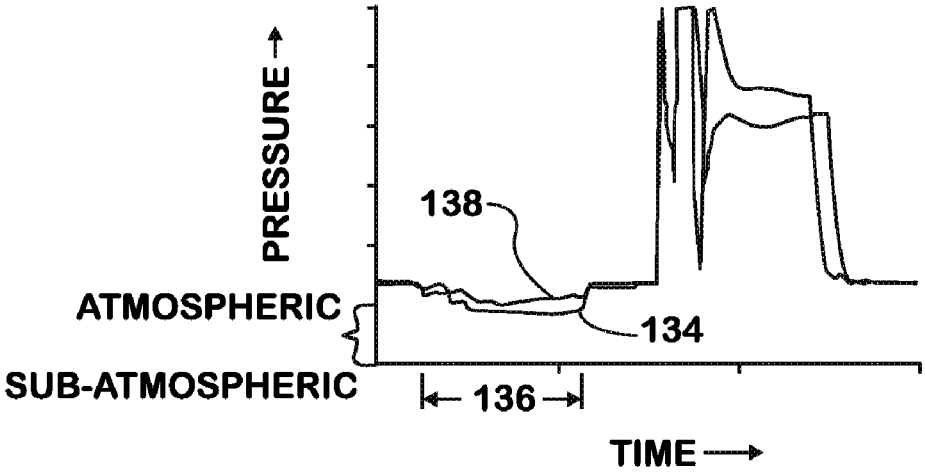

FIG. 8 shows the effect of accumulator 62 on pressure in snubber chamber 96. In the absence of the accumulator, a first trace 134 shows that oil rail 70 is incapable of satisfying the expanding volume of chamber 96 as valve 18 opens because a partial vacuum is drawn in chamber 96, i.e. cavitation occurs, during the portion of the engine cycle marked 136. Accumulator 62 mitigates the cavitation by providing an additional oil source to chamber 96 through the snubber's variable restriction that becomes less restrictive as snubbing element 98 increasingly extends. Trace 138 shows that no vacuum is drawn in the snubber chamber.

Figure 9:
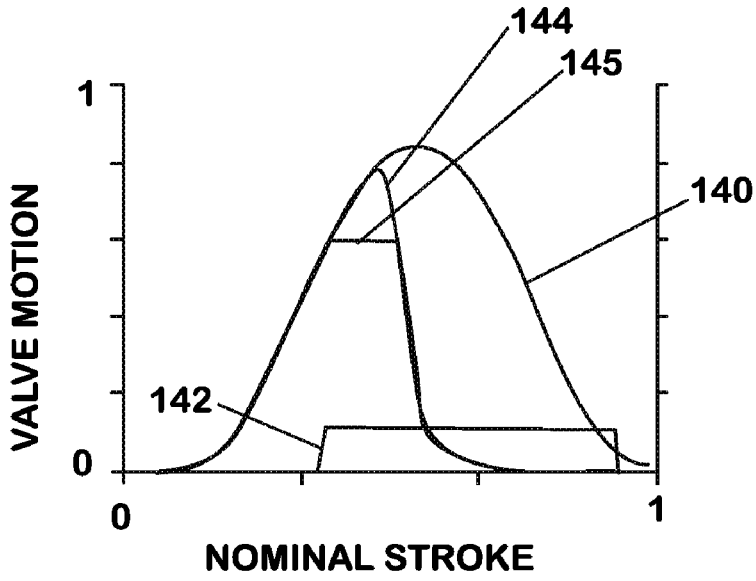

FIG. 9 graphically portrays a portion of an engine cycle with and without early IVC. A trace 140 depicts valve motion that occurs without early IVC by keeping actuator 58 hydraulically locked. A trace 142 shows control valve 60 opening to cause early IVC. In response to control valve 60 opening, a trace 144 shows that valve 18 begins closing early and reseats closed earlier than in the absence of early IVC. Valve 60 is allowed to close and re-lock actuator 58 only after valve 18 has re-seated. A trace 145 shows snubbing element 98 extending as the intake valve opens until shoulder 128 abuts lip 130 at full extension.

Mechanism 40 can be fabricated as a "bolt-on" unit for association with an engine valve train. Fast-acting valve 60 and actuator 58 coact to promptly begin closing the intake valve in response to a closing command.

The ability of axis 54 to relocate allows a mechanism 40 to function a) both as a hydraulic lifter in the absence of an IVC-adjust command and b) as a retracting element to close the respective intake valve at a rate determined by geometries of the respective actuator 58, fast-acting valve 60, and snubber 64. The landing speed of the intake valve is set or controlled by one or a combination of a control algorithm applied to valve 60 and of a specific snubber design characterized by a unique scheduling area geometry, where the area prescribes a constant landing speed and the "late" hole, i.e. through-aperture 116, ensures that the intake valve can land under all conditions.

Because accumulator 62 can accept oil from actuator 58 and quickly deliver at least some of that oil to snubber 64 at the proper time in an engine cycle, snubbing element 98 can have a relatively long linear stroke and avoid the cavitation exemplified by trace 134 in FIG. 8. Because the accumulator has exposure to both the actuator 58 and oil rail 70, mechanism 40 uses relatively little "new" oil during each engine cycle while operating at speeds appropriate for fast-acting valve 60.

If engine 10 is shut down for some length of time, some leakage may occur, resulting in loss of some pressure and the formation of air bubbles in the hydraulic system of mechanism 40, including actuator 58. To mitigate or even totally avoid the effect of such air bubbles on performance of the mechanism, it and the engine are operated in a particular way before the engine commences running under its own power.

As the engine is being cranked, fast-acting valve 60 is opened at an appropriate crank angle of the cycle for the corresponding engine cylinder to invoke some degree of early IVC for the purpose of purging air from actuator 58. The opening of valve 60 unlocks actuator 58 so that the force of spring 44 acting on rocker 52 will force some oil, and any entrained air that the oil may contain, out of actuator 58 and into accumulator 62 and/or oil rail 70. After intake valve 18 closes, fast-acting valve 60 stays open long enough before being closed to allow accumulator 62 to push oil back through valve 60 and into actuator 58 to cause pin 84 to return to the position of FIG. 3. Continuation of this process during engine cranking restores lost pressure and eliminates air bubbles. The degree of early IVC for the purpose of air purge is controlled so as not to impair the ability to start the engine.

Once the engine starts and accelerates to idle under its own power, air purge of actuator 58 can be continued by opening fast-acting valve 60 earlier in the engine cycle for the particular cylinder to allow for the idle speed being greater than the cranking speed. After some length of time, the air purge strategy for mechanism 40 ends, and mechanism 40 is controlled by whatever other variable valve actuation (VVA) strategy or strategies in ECM 36 is or are appropriate for particular engine operating conditions.

What is claimed is:

1. An internal combustion engine comprising:

an intake system through which air enters at least one engine cylinder within which the air supports combustion of fuel to operate the engine;

an exhaust system through which products of in-cylinder combustion are exhausted;

cylinder valves for controlling communication of the respective systems with the at least one cylinder, one of which valves is biased closed by a valve spring to seat on a valve seat but is increasingly opened by a rocker of a valve opening mechanism pivoting about a relocatable pivot axis and increasingly compressing the valve spring;

a hydraulic actuator for hydraulically locking the relocatable pivot axis against relocation as the one valve is being increasingly opened by the rocker, and with the one valve open, unlocking the relocatable pivot axis to allow the valve spring to increasingly expand and simultaneously force the one valve toward the valve seat and the relocatable pivot axis to relocate;

a hydraulic fluid pressure source for delivering hydraulic fluid through a first check valve to a variable volume chamber of a hydraulic snubber that is disposed to snub motion of the one valve toward the valve seat, through a second check valve to a variable volume chamber of the hydraulic actuator, and to a hydraulic accumulator that is in fluid communication with the variable volume chamber of the hydraulic snubber and a first port of a control valve that has a second port in fluid communication with the variable volume chamber of the hydraulic actuator;

the variable volume chamber of the hydraulic snubber being cooperatively defined by a snubbing element and by a snubber body with respect to which the snubbing element is extendable and retractable;

the snubbing element and the snubber body collectively comprising a variable restriction through which the variable volume chamber of the hydraulic snubber is in fluid communication with the hydraulic accumulator, the hydraulic fluid pressure source, and the first port of the control valve, and which decreases and increases respectively as the snubbing element extends and retracts respectively relative to the snubber body;

the hydraulic fluid source and accumulator collectively being effective, as the valve opening mechanism is increasingly opening the one valve, to force hydraulic fluid into the variable volume chamber of the hydraulic snubber and thereby extend the snubbing element relative to the snubber body;

during increasing opening of the one valve by the valve opening mechanism, the control valve closing the first port to the second port to hydraulically lock the hydraulic actuator by preventing hydraulic fluid that had been forced into the variable volume chamber of the hydraulic actuator before the one valve was unseated from the valve seat from escaping from the variable volume chamber of the hydraulic actuator;

and with the one valve open, the control valve opening the first port to the second port to unlock the hydraulic actuator by communicating the variable volume chamber of the hydraulic actuator to the accumulator and consequently allow the valve spring to force hydraulic fluid out of the variable volume chamber of the hydraulic actuator into the accumulator as the one valve is being forced toward the seat by the valve spring and snubbed by interaction with the hydraulic snubber that forces the snubbing element to retract and force fluid out of the variable volume chamber of the hydraulic snubber into the accumulator with increasing restriction as the one valve moves toward the seat.

2. An internal combustion engine as set forth in claim 1 in which the one cylinder valve comprises an intake valve through which the intake system communicates with a respective one of the cylinders.

3. An internal combustion engine as set forth in claim 2 in which the relocatable pivot axis comprises the central longitudinal axis of a cylindrical pin through which the rocker and a piston rod of the actuator are operatively coupled together.

4. An internal combustion engine as set forth in claim 3 in which the rocker comprises opposite ends disposed to either side of the pin, one of the opposite ends providing a point of interaction between the rocker and the intake valve and the other of the opposite ends providing a point of interaction with an end of a push rod that is operated by a cam on a camshaft of the engine.

5. An internal combustion engine as set forth in claim 2 in which the hydraulic fluid pressure source comprises an oil rail that is kept filled with pressurized oil by a pump that pumps oil into the oil rail through a third check valve.

6. An internal combustion engine as set forth in claim 5 in which the snubbing element comprises a head end that protrudes from the snubber body to interact with the intake valve and a tail end that remains inside the snubber body as the snubbing element extends and retracts, and in which the variable restriction is cooperatively defined by a scheduling aperture geometry that extends through a hollow cylindrical wall portion of the tail end of the snubbing element and that moves across an undercut in an inner surface of a cylindrical wall portion of the snubber body surrounding the hollow cylindrical wall portion of the tail end of the snubbing element as the snubbing element is increasingly retracted.

7. An internal combustion engine as set forth in claim 6 in which the hollow cylindrical wall portion of the tail end of the snubbing element is closed to the head end of the snubbing element and opposite the head end, is in communication with the hydraulic fluid pressure source via a through-passage in the snubber body, and the undercut is in communication with the accumulator so that as the snubbing element is increasingly retracted, fluid is forced out of the hollow interior wall portion of the tail end of the snubbing element through the scheduling aperture geometry and as the snubbing element is increasingly extended, fluid enters the variable volume chamber of the hydraulic snubber through the scheduling aperture geometry.

8. An internal combustion engine as set forth in claim 7 in which the undercut extends 360° around the cylindrical wall portion of the snubber body.

9. An internal combustion engine as set forth in claim 8 in which the undercut has a constant axial dimension throughout the cylindrical wall portion of the snubber body.

10. An internal combustion engine as set forth in claim 9 in which the scheduling aperture geometry comprises multiple discrete through-apertures.

11. An internal combustion engine as set forth in claim 10 in which the multiple discrete through-apertures are arranged in a pattern where a first one is offset both circumferentially and axially to a second one.

12. An internal combustion engine as set forth in claim 11 in which the first through-aperture is more distant from the head end of the snubbing element than is the second through-aperture, and the first through-aperture also has an open area that is greater than that of the second through-aperture.

13. An internal combustion engine as set forth in claim 12 in which the second through-aperture confronts the undercut during a final increment of travel of the intake valve approaching re-seating and when the intake valve finally re-seats.

14. An internal combustion engine as set forth in claim 13 in which the second through-aperture is the only through-aperture that confronts the undercut during a final increment of travel of the intake valve approaching re-seating and when the intake valve finally re-seats.

15. An internal combustion engine as set forth in claim 6 in which the hydraulic snubber comprises a stop that limits extension of the snubbing element with respect to the snubber body.

16. An internal combustion engine as set forth in claim 1 in which the control valve comprises an electric operator that is selectively energized by electricity to control opening and closing between the first and second ports.

17. A mechanism for association with an engine cylinder valve that is biased closed on a valve seat by a valve spring and opened by a valve rocker of a valve opening mechanism for endowing the cylinder valve with the capability of being operated from open to closed at various times during engine cycles, the mechanism comprising:

a hydraulic actuator comprising a variable volume chamber, a control valve controlling the hydraulic actuator a) to constrain a relocatable pivot axis of the valve rocker against relocation while the valve opening mechanism is operating the valve rocker to force the cylinder valve increasingly open and increasingly compressing the valve spring, and b) to release the constraint of the relocatable pivot axis after the cylinder valve has been forced open for enabling the relocatable pivot axis to relocate as the valve spring increasingly extends to move the cylinder valve toward closing on the valve seat, a first check valve for allowing hydraulic fluid from a hydraulic fluid pressure source and a hydraulic accumulator that is in fluid communication with the source to be introduced to expand the volume of the variable volume chamber of the hydraulic actuator and disallowing back-flow of fluid from the variable volume chamber of the hydraulic actuator, a hydraulic snubber comprising a variable volume chamber for snubbing motion of the cylinder valve toward closing on the valve seat, a second check valve for allowing hydraulic fluid from the hydraulic fluid pressure source to expand the volume of the variable volume chamber of the hydraulic snubber and disallowing back-flow of fluid from the variable volume chamber of the hydraulic snubber, the variable volume chamber of the snubber being cooperatively defined by a snubbing element and by a snubber body with respect to which the snubbing element is extended by hydraulic fluid introduced into the snubber through the second check valve, the snubbing element and the snubber body cooperatively comprising a variable restriction through which the variable volume chamber of the hydraulic snubber communicates with the accumulator and which varies as the snubbing element retracts relative to the snubber body, the control valve providing the functions of causing the hydraulic actuator to constrain the relocatable pivot axis against relocation by closing the variable volume chamber of the hydraulic actuator to the accumulator and of causing the hydraulic actuator to release the constraint of the relocatable pivot axis by opening the variable volume chamber of the hydraulic actuator to the accumulator and consequently enable the valve spring to act via the rocker to force fluid out of the variable volume chamber of the hydraulic actuator into the accumulator, and via cylinder valve interaction with the snubbing element, to force fluid out of the variable volume chamber of the hydraulic snubber and into the accumulator with increasing restriction of fluid flow by the variable restriction as the snubbing element is increasingly retracted.

18. A mechanism as set forth in claim 17 in which the snubbing element comprises a head end that protrudes from the snubber body to interact with the intake valve and a tail end that remains inside the snubber body as the snubbing element extends and retracts, and in which the variable restriction is cooperatively defined by a scheduling aperture geometry that extends through a hollow cylindrical wall portion of the tail end of the snubbing element and that moves across an undercut in an inner surface of a cylindrical wall portion of the snubber body surrounding the hollow cylindrical wall portion of the tail end of the snubbing element as the snubbing element is increasingly retracted.

19. A mechanism as set forth in claim 18 in which the hollow cylindrical wall portion of the tail end of the snubbing element is closed to the head end of the snubbing element and opposite the head end, is in communication with the hydraulic fluid pressure source via a through-passage in the snubber body, and the undercut is in communication with the accumulator so that as the snubbing element is increasingly retracted, fluid is forced out of the hollow interior wall portion of the tail end of the snubbing element through the scheduling aperture as the scheduling aperture geometry moves across the undercut.

20. A mechanism as set forth in claim 19 in which the undercut extends 360° around the cylindrical wall portion of the snubber body and has a constant axial dimension throughout the cylindrical wall portion of the snubber body, and in which the scheduling aperture geometry comprises multiple discrete through-apertures.

21. A mechanism as set forth in claim 20 in which the multiple discrete through-apertures are arranged in a pattern where a first through-aperture is offset both circumferentially and axially to a second through-aperture, the first through-aperture is more distant from the head end of the snubbing element than is the second, and the first through-aperture also has an open area that is greater than that of the second through-aperture.

22. A mechanism as set forth in claim 21 in which the second through-aperture is the only through-aperture that confronts the undercut when the snubbing element is fully retracted.

23. A mechanism as set forth in claim 17 in which the control valve comprises an electric actuator that is selectively energized by electricity to control its functions.

24. A method of operating an engine cylinder valve that is biased closed on a valve seat by a valve spring, that is opened by pivoting of a valve rocker of a valve opening mechanism about a relocatable axis during an engine cycle, and whose closing motion toward the valve seat is snubbed by a hydraulic snubber, the method comprising:

communicating a variable volume chamber of the hydraulic snubber through a first check valve to a hydraulic fluid pressure source to allow fluid flow into the variable volume chamber of the hydraulic snubber and disallow backflow from the variable volume chamber of the hydraulic snubber;

communicating a variable volume chamber of a hydraulic actuator through a second check valve to a hydraulic accumulator that is in fluid communication with the hydraulic fluid pressure source to allow fluid to flow into the variable volume chamber of the hydraulic actuator and disallow backflow from the variable volume chamber of the hydraulic actuator;

communicating the variable volume chamber of the hydraulic actuator through a control valve to the source, the variable volume chamber of the hydraulic snubber, and the hydraulic accumulator;

selectively operating the control valve a) to constrain the relocatable pivot axis of the valve rocker against relocation by closing the variable volume chamber of the hydraulic actuator to the accumulator, the source, and the variable volume chamber of the hydraulic snubber as the valve opening mechanism is operating the valve rocker to force the cylinder valve increasingly open and increasingly compressing the valve spring, thereby hydraulically locking the actuator during cylinder valve opening, and b) after the cylinder valve has been forced open, to release the constraint of the relocatable pivot axis by opening the variable volume chamber of the hydraulic actuator to the accumulator, the source, and the volume chamber of the hydraulic snubber, thereby unlocking the hydraulic actuator so that the relocatable axis can relocate as the valve spring increasingly extends to force fluid out of the volume chamber of the hydraulic actuator and move the cylinder valve toward closing on the valve seat;

and as the cylinder valve interacts with the snubber during closing motion toward the valve seat, snubbing the closing motion by causing the snubber to increasingly restrict flow of hydraulic fluid being forced out of the volume chamber of the hydraulic snubber by the valve spring forcing the cylinder valve toward the valve seat.

25. A hydraulic snubber for snubbing closing motion of an engine cylinder valve on a seat, the snubber comprising:

a variable volume chamber cooperatively defined by a snubbing element and by a body with respect to which the snubbing element is linearly displaceable;

a source port through which hydraulic fluid from a hydraulic fluid pressure source can be delivered to the variable volume chamber for hydraulically biasing the snubbing element in a direction of linear extension with respect to the body;

a drain port through which hydraulic fluid from the variable volume chamber can drain when closing motion of the cylinder valve forces the snubbing element in a direction of linear retraction with respect to the body; and a variable restriction through which hydraulic fluid in the variable volume chamber is forced to the drain port when the snubbing element is displaced in the direction of linear retraction;

the variable restriction comprising a scheduling aperture geometry that extends through a hollow cylindrical wall portion of a tail end of the snubbing element and that moves across an undercut in an inner surface of a cylindrical wall portion of the snubber body surrounding the hollow cylindrical wall portion of the tail end of the snubbing element as the snubbing element is displaced in the direction of linear refraction.

26. A hydraulic snubber as set forth in claim 25 in which the undercut extends 360° around the cylindrical wall portion of the snubber body and has a constant axial dimension throughout the cylindrical wall portion of the snubber body, and in which the scheduling aperture geometry comprises multiple discrete through-apertures.

27. A hydraulic snubber as set forth in claim 26 in which the multiple discrete through-apertures are arranged in a pattern where a first one is offset both circumferentially and axially to a second one, the first through-aperture is more distant from an axial end of the snubbing element than is the second through-aperture, and the first through-aperture also has an open area that is greater than that of the second through-aperture.

28. A hydraulic snubber as set forth in claim 27 in which the second through-aperture is the only through-aperture that confronts the undercut when the snubbing element is fully linearly refracted.

29. A method for using early IVC in an internal combustion engine that has a VVA mechanism having a hydraulic actuator for controlling the location of the pivot axis of a rocker through which motion of a push rod is transmitted to open a cylinder intake valve that is biased closed by a valve spring and a selectively operable control valve that is selectively opened and closed to hydraulically unlock and lock the hydraulic actuator for allowing and disallowing the location of the pivot axis to move away from a defined location that provides no early IVC to a location that provides early IVC, the method comprising:

opening the control valve during engine cranking to provide early IVC that causes some oil and any entrained air to be forced out of the hydraulic actuator to an hydraulic accumulator that has fluid communication with a source of pressurized oil by action of the valve spring causing the pivot axis to move from the defined location to a location that provides early IVC, and after the intake valve closes, keeping the control valve open to allow oil to return from the accumulator to the hydraulic actuator and move the relocatable pivot axis to the defined location.

* * * * *